US008751220B2

(12) United States Patent
Zhang et al.

(10) Patent No.: US 8,751,220 B2
(45) Date of Patent: Jun. 10, 2014

(54) MULTIPLE MICROPHONE BASED LOW COMPLEXITY PITCH DETECTOR

(75) Inventors: Xianxian Zhang, San Diego, CA (US); Alfonsus Lunardhi, San Diego, CA (US)

(73) Assignee: Broadcom Corporation, Irvine, CA (US)

( * ) Notice: Subject to any disclaimer, the term of this patent is extended or adjusted under 35 U.S.C. 154(b) by 26 days.

(21) Appl. No.: 13/290,907

(22) Filed: Nov. 7, 2011

(65) Prior Publication Data

US 2013/0117014 A1 May 9, 2013

(51) Int. Cl.
*G10L 21/00* (2013.01)

(52) U.S. Cl.
CPC ..... *G10L 21/00* (2013.01)
USPC ..... 704/207

(58) Field of Classification Search
CPC ..... G10L 21/00
USPC ..... 704/207
See application file for complete search history.

(56) References Cited

U.S. PATENT DOCUMENTS

| | | | | |
|---|---|---|---|---|
| 5,874,686 | A * | 2/1999 | Ghias et al. | 84/609 |
| 8,175,871 | B2 * | 5/2012 | Wang et al. | 704/227 |
| 8,223,980 | B2 * | 7/2012 | Dooling et al. | 381/56 |
| 8,306,234 | B2 * | 11/2012 | Christoph et al. | 381/17 |

* cited by examiner

*Primary Examiner* — Susan McFadden
(74) *Attorney, Agent, or Firm* — McDermott Will & Emery LLP

(57) ABSTRACT

Various embodiments of multiple microphone based pitch detection are provided. In one embodiment, a method includes obtaining a primary signal and a secondary signal associated with multiple microphones. A pitch value is determined based at least in part upon a level difference between the primary and secondary signals. In another embodiment, a system includes a plurality of microphones configured to provide a primary signal and a secondary signal. A level difference detector is configured to determine a level difference between the primary and secondary signals and a pitch identifier is configured to clip the primary and secondary signals based at least in part upon the level difference. In another embodiment, a method determines the presence of voice activity based upon a pitch prediction gain variation that is determined based at least in part upon a pitch lag.

20 Claims, 8 Drawing Sheets

MULTIPLE MICROPHONE BASED LOW COMPLEXITY PITCH DETECTOR

BACKGROUND

Modern communication devices often include a primary microphone for detecting speech of a user and a reference microphone for detecting noise that may interfere with accuracy of the detected speech. A signal that is received by the primary microphone is referred to as a primary signal and a signal that is received by the reference microphone is referred to as a noise reference signal. In practice, the primary signal usually includes a speech component such as the user's speech and a noise component such as background noise. The noise reference signal usually includes reference noise (e.g., background noise), which may be combined with the primary signal to provide a speech signal that has a reduced noise component, as compared to the primary signal. The pitch of the speech signal is often utilized by techniques to reduce the noise component.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

In mobile audio processing such as, e.g., a cellular phone application, pitch information is desired by several audio sub-systems. For example, pitch information may be used to improve the performance of an echo canceller, a single or multiple microphone (multi-mic) noise reduction system, wind noise reduction system, speech coders, etc. However, due to the complexity and processing requirements of the available pitch detectors, use of the pitch detection is limited within the mobile unit. Morever, when applying the traditional pitch detector in a dual microphone platform, the complexity and processing requirements (or consumed MIPS) may double. The complexity may be further exacerbated in platforms using multi-mic configurations. The described low complexity multiple microphone based pitch detector may be used in dual-mic applications including, e.g., a primary microphone positioned on the front of the cell phone and a secondary microphone positioned on the back, as well as other multi-mic configurations.

Further, the speech signal from the primary microphone is often corrupted by noise. Many techniques for reducing the noise of the noisy speech signal involve estimating the pitch of the speech signal. For example, single-channel autocorrelation based pitch detection technique has been proposed for providing pitch estimation of the speech signal. And preprocessing techniques are often used by the single-channel autocorrelation based pitch detectors, and are able to significantly increase detection accuracy and reduce computation complexity. These preprocessing techniques are center clipping technique, infinite peak clipping technique, etc. However, determination of the clipping level can significantly affect the effectiveness of the pitch detection. In many cases, a fixed threshold is not sufficient for non-stationary noise environments.

Figure 1:
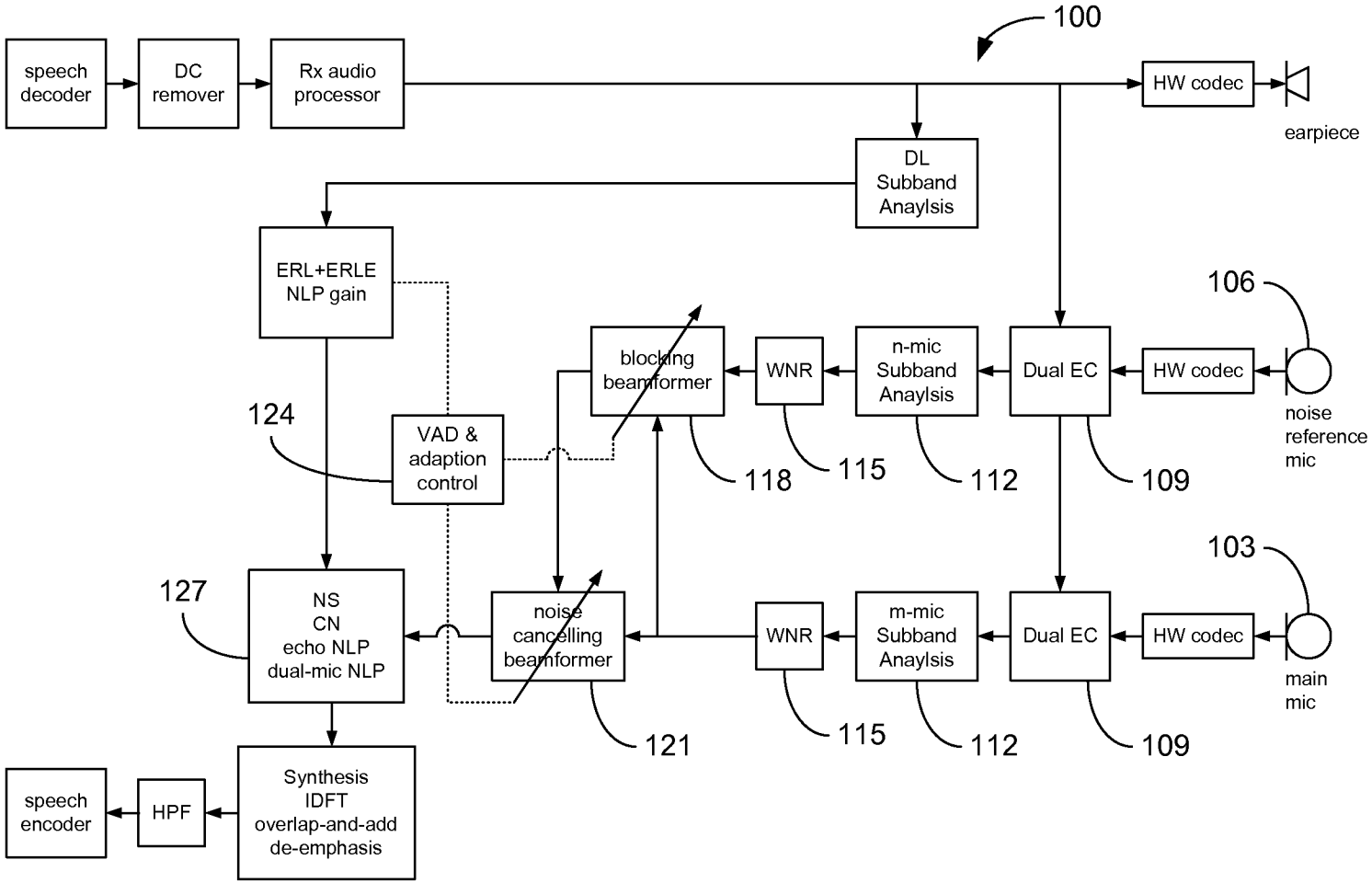
FIG. 1 is a graphical representation of an example of a dual-mic DSP audio system in accordance with various embodiments of the present disclosure.

With reference to FIG. 1, shown is a graphical representation of an example of a dual-mic DSP (digital signal processing) audio system 100 used for noise suppression. Signals are obtained from microphones operating as a primary (or main) microphone 103 and a secondary microphone (also called noise reference microphone) 106, respectively. The signals from the main microphone 103 and noise reference microphone 106 pass through time-domain echo cancellation (EC) 109 before conversion to the frequency-domain using subband analysis 112. In other implementations, the EC 109 may be carried out in the frequency domain after conversion. In the frequency-domain, wind noise reduction (WNR) 115, linear cancellation using generalized side-lobe cancellation (GSC), and dual-mic non-linear processing (NLP) are performed on the converted signals. Frequency-domain GSC includes a blocking matrix/beamformer/filter 118 and a noise cancelling beamformer/filter 121. The blocking matrix 118 is used to remove the speech component (or undesired signal) in the path (or channel) of the noise reference microphone 106 to get a "cleaner" noise reference signal. Ideally, the output of the blocking matrix 118 only consists of noise. The blocking matrix output is used by the noise cancelling filter 121 to cancel the noise in the path (or channel) of the main microphone 103. The frequency-domain approach provides better convergence speed and more flexible control in suppression of noise. The dual-mic DSP audio system 100 may be embodied in dedicated hardware, and/or software executed by a processor and/or other general purpose hardware.

A multi-mic based pitch detector may utilize various signals from the dual-mic DSP audio system 100. For example, the pitch may be based upon signals obtained from the main microphone 103 and noise reference microphone 106 or signals obtained from the blocking matrix/beamformer 118 and the noise cancelling beamformer 121. The low complexity multiple microphone based pitch detector allows for implementation at multiple locations within an audio system such as, e.g., the dual-mic DSP audio system 100. For instance, individual pitch detectors may be included for use by the time-domain EC 109, by the WNR 115, by the blocking matrix 118, by the noise cancelling filter 121, by the VAD control block 124, by the NS-NLP 127, etc. In addition to DSP audio system 100, the low complexity multi-mic based pitch detector may also be used by speech coder, speech recognition system, etc. for improving system performance and providing more robust pitch estimation.

Figure 2:
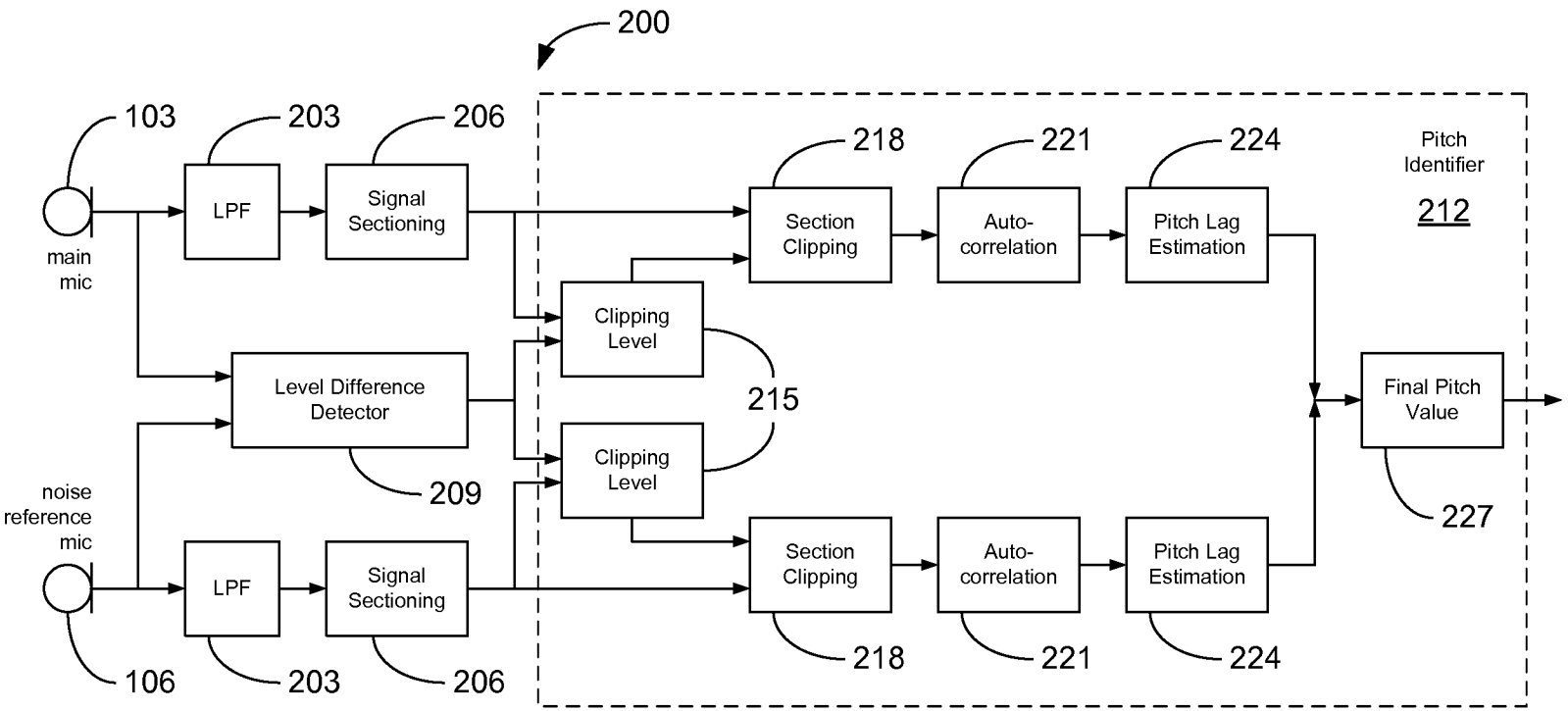
FIGS. 2 and 5-7 are graphical representations of examples of a low complexity multiple microphone (multi-mic) based pitch detector in accordance with various embodiments of the present disclosure.

Referring now to FIG. 2, shown is a graphical representation of an example of a low complexity multi-mic based pitch detector 200. In the example of FIG. 2, input signals from a primary (or main) microphone 103 and a secondary microphone 106 are first sent through a low pass filter (LPF) 203 to limit the bandwidth of the signals. A finite impulse response (FIR) filter having a cutoff frequency below 1000 Hz may be used. For example, the LPF may be a 12-order FIR filter with a cutoff frequency of about 900 Hz. Other filter orders may be used for the FIR filter. Infinite impulse response (IIR) filters (e.g., a 4-order IIR filter) may also be used as the LPF 203. Signal sectioning 206 obtains overlapping signal sections (or analysis windows) of the filtered signals for processing. Each signal section includes a pitch searching period (or frame) and a portion that overlaps with an adjacent signal section. In one implementation, the output of a low pass filter is sectioned into 30 ms sections with a pitch searching period (or frame) of, e.g., 10 ms and an overlapping portion of, e.g., 20 ms. In other implementations, shorter or longer signal sections (or analysis windows) may be used such as, e.g., 15 or 45 ms. Pitch searching periods (or frames) may be in the range of, e.g., about 5 ms to about 15 ms. Other pitch searching periods may be used and/or the overlapping portion may be varied as appropriate. Performance of the pitch detector may be affected with variations in the pitch searching period.

In the low complexity multi-mic based pitch detector 200, a level difference detector 209 determines the level difference between the input signals from the primary and secondary microphones 103 and 106 for the pitch searching period. In the example of FIG. 2, the level difference detector 209 uses the input signals from the main microphone 103 and noise reference microphone 106 before the LPF 203. In other implementations, the signals at the output of the LPF 203 or the signal sections after sectioning 206 may be used to determine the level difference. The ratio of the averaged Teager Energy Operator (TEO) energy for the signals may be used to represent the level difference 209. The TEO energy is described in "On a simple algorithm to calculate the 'energy' of a signal" by J. F. Kaiser (Proc. IEEE ICASSP'90, vol. 1, pp. 381-384, April 1990, Albuquerque, N.M.). Other ratios, such as the averaged energy ratio, the log of the energy ratio, the averaged absolute amplitude ratio, etc. can also be used to represent the level difference. Moreover, this ratio may be determined in either time domain or frequency domain.

A pitch identifier 212 obtains the sectioned signals from the signal sectioning 206 and the level difference from the level difference detector 209. A clipping level is determined in a clipping level stage 215. The sectioned signal is divided into three consecutive equal length subsections (e.g., three consecutive 10 ms subsections of a 30 ms signal section). The maximum absolute peak levels for the first and third subsections are then determined. The clipping level ($C_L$) is then set as the adaptive factor $\alpha$ multiplied by the smaller (or minimum) of the two maximum absolute peak levels for the first and third subsections or $C_L=\alpha\times\min\{\max(\text{first subsection absolute peak levels}), \max(\text{third subsection absolute peak levels})\}$.

Figure 3:
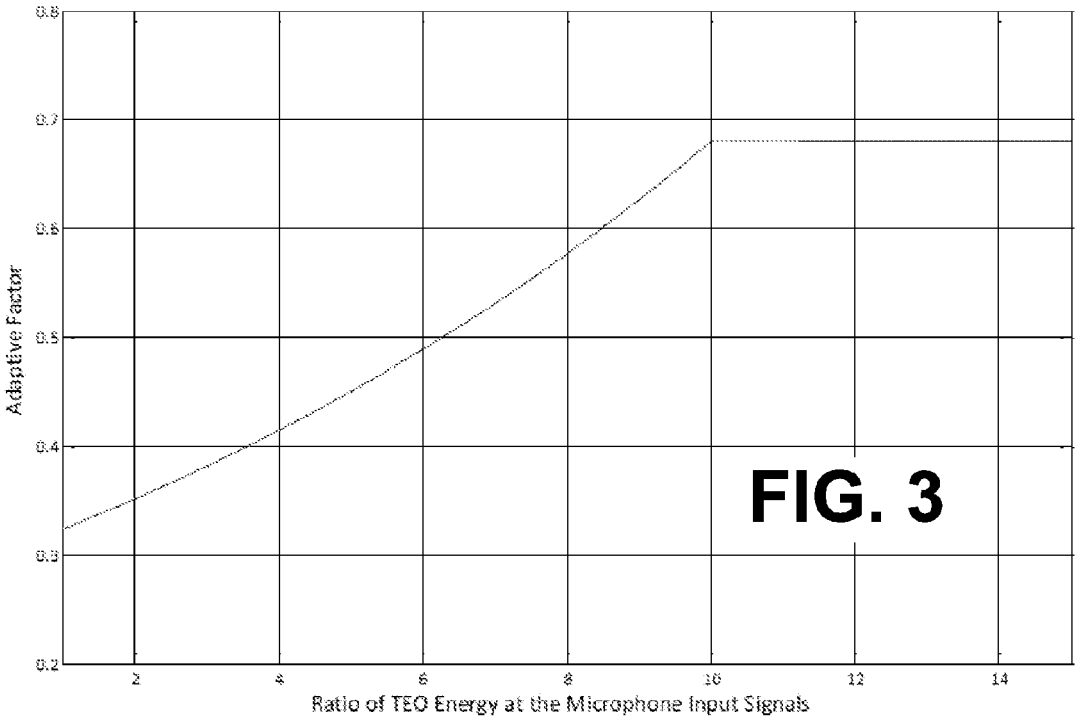
FIG. 3 is a plot illustrating an example of a relationship between an adaptive factor (used for determining a clipping level) and the ratio of the Teager Energy Operator (TEO) energy between primary and secondary microphone input signals of a low complexity multi-mic based pitch detector of FIG. 2 in accordance with various embodiments of the present disclosure.

The adaptive factor $\alpha$ is obtained using the level difference from the level difference detector 209. For example, the determined adaptive factor $\alpha$ may be based upon a relationship such as depicted in FIG. 3. In the example of FIG. 3, the adaptive factor $\alpha$ varies from a minimum value to a maximum value based upon the ratio of the averaged TEO energy ($R_{TEO}$) for the input signals from the main microphone 103 and noise reference microphone 106. The variation of the adaptive factor $\alpha$ between the minimum and maximum $R_{TEO}$ values may be exponential, linear, quadratic, etc. The variation of the adaptive factor $\alpha$ may be defined by an exponential function, linear function, quadratic function, or other function (or combination of functions) as can be understood. For instance, in the example of FIG. 3, if $R_{TEO}<0.1$, then $\alpha=0.3$ and if $R_{TEO}>10$, then $\alpha=0.68$. Otherwise $\alpha=0.2974\cdot\exp(0.0827\cdot R_{TEO})$.

The $R_{TEO}$ range between the minimum and maximum values, as well as the minimum and maximum values themselves, may vary depending on the characteristics and location of microphones 103 and 106. The minimum and maximum values, $R_{TEO}$ range, and relationship between a and $R_{TEO}$ may be determined through testing and tuning of the pitch detector. The clipping level stages 215 may independently determine clipping levels and adaptive factors $\alpha$ for each input signal (or microphone) channel as illustrated in FIG. 2 or a common clipping level and adaptive factor $\alpha$ may be determined for both input signal channels.

Figure 4:
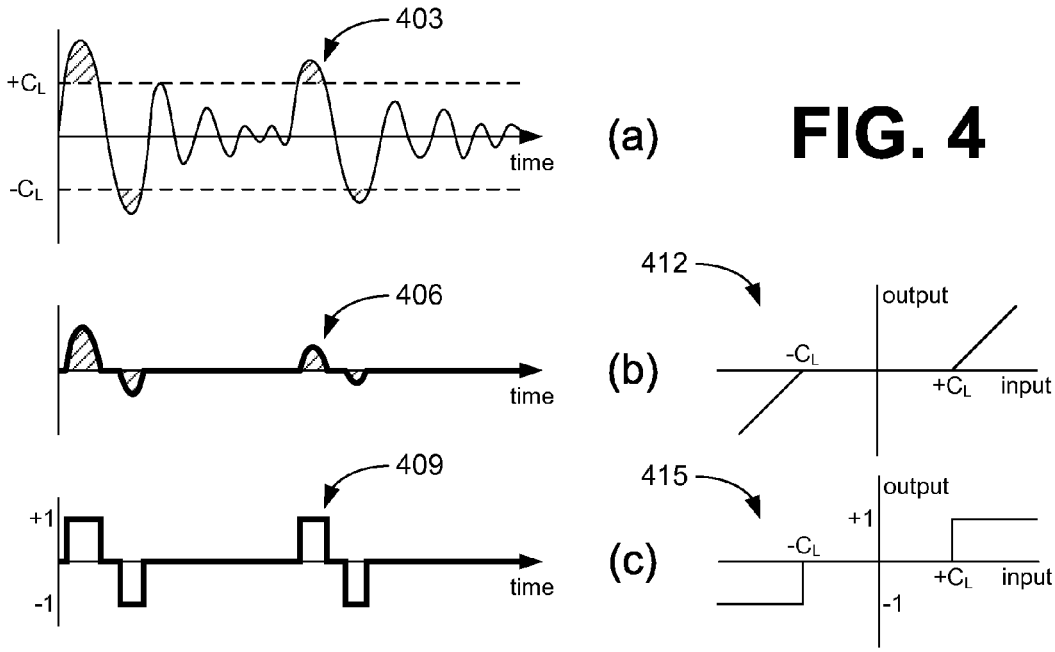
FIG. 4 is a graphical representation of signal clipping in low complexity multi-mic based pitch detectors of FIGS. 2 and 5-7 in accordance with various embodiments of the present disclosure.

Following the determination of the clipping level, the sectioned signals of both input signal (or microphone) channels are clipped based upon the clipping level in section clipping stages 218. The sectioned signal may be clipped using center clipping, infinite peak clipping, or other appropriate clipping scheme. FIG. 4 illustrates center clipping and infinite peak clipping of an input signal based upon the clipping level ($C_L$). FIG. 4(*a*) depicts an example of an input signal 403. FIG. 4(*b*) illustrates a center clipped signal 406 and FIG. 4(*c*) illustrates an infinite peak clipped signal 409 generated from the input signal 403. When the input signal 403 remains within the threshold levels of $+C_L$ and $-C_L$, the output is generated as zero as illustrated in FIGS. 4(*b*) and 4(*c*). In the case of center clipping, a linear output 412 is generated when the input signal 403 is outside the threshold range of $+C_L$ to $-C_L$ to produce the center clipped signal 406 of FIG. 4(*b*). In the case of infinite peak clipping, a positive or negative unity output 415 is generated during the time the input signal 403 is outside the threshold range of $+C_L$ to $-C_L$ to produce the infinite peak clipped signal 409 of FIG. 4(*c*). Otherwise, the output 415 is zero.

Referring back to FIG. 2, normalized autocorrelation 221 is performed on each clipped signal section to determine corresponding pitch values. Pitch lag estimation stages 224 search for the maximum correlation values and thus determine the position of this peak value, which represents the pitch information for both input signal (or microphone) channels during the current pitch searching period. A final pitch value for the current pitch searching period is then determined by a final pitch stage 227. The final pitch value for the current pitch searching period is based at least in part upon the determined pitch values for the current pitch searching period and one or more previous pitch searching period(s) from both input signal channels. For example, the difference between the pitch values for the current pitch searching period and the previous pitch searching period may be compared to one or more predefined threshold(s) to determine the final pitch value. The final pitch value may then be provided by the final pitch stage 227 to improve, e.g., echo cancellation 109, wind noise reduction 115, speech encoding in FIG. 1, etc.

The following pseudo code shows an example of the steps that may be carried out to determine the final pitch value.

```
%     if ((abs(P2 − P2_pre) < Thres1 ) or (abs(P2 − P1_pre) <
      Thres1 )) {
%        if ((abs(P1 − P1_pre) < Thres2 ) or (abs(P1 − P2_pre) <
         Thres2 )) {
%           P = P1;
%        } else {
%           P = P2;
%        }
% } elseif ((abs(P1 − P1_pre) < Thres1 ) or (abs(P1 − P2_pre) <
  Thres1 )) {
%        if ((abs(P2 − P2_pre) < Thres2 ) or (abs(P2 − P1_pre) <
         Thres2 )) {
%           P = P2;
%        } else {
%           P = P1;
%        }
% } else {
%     P = min(P1, P2);
% }
```

In this example, "P1" represents the pitch value corresponding to the current pitch searching period for the primary channel associated with the primary microphone 103; "P1_pre" represents the pitch value corresponding to the previous pitch searching period for the primary channel; "P2" represents the pitch value corresponding to the current pitch searching period for the secondary channel associated with the secondary microphone 106; "P2_pre" represents the pitch value corresponding to the previous pitch searching period for the secondary channel; and "P" represents the final pitch value corresponding to the current pitch searching period. As can be seen, if the difference between the pitch values for the current pitch searching period and the previous pitch searching period fall within predefined thresholds (e.g., "Thres1" and "Thres2"), then the final pitch value is determined based upon the threshold conditions. Otherwise, the final pitch value is the minimum of the pitch values corresponding to the current pitch searching period. The thresholds (e.g., "Thres1" and "Thres2") may be based on pitch changing history, testing, etc.

Figure 5:
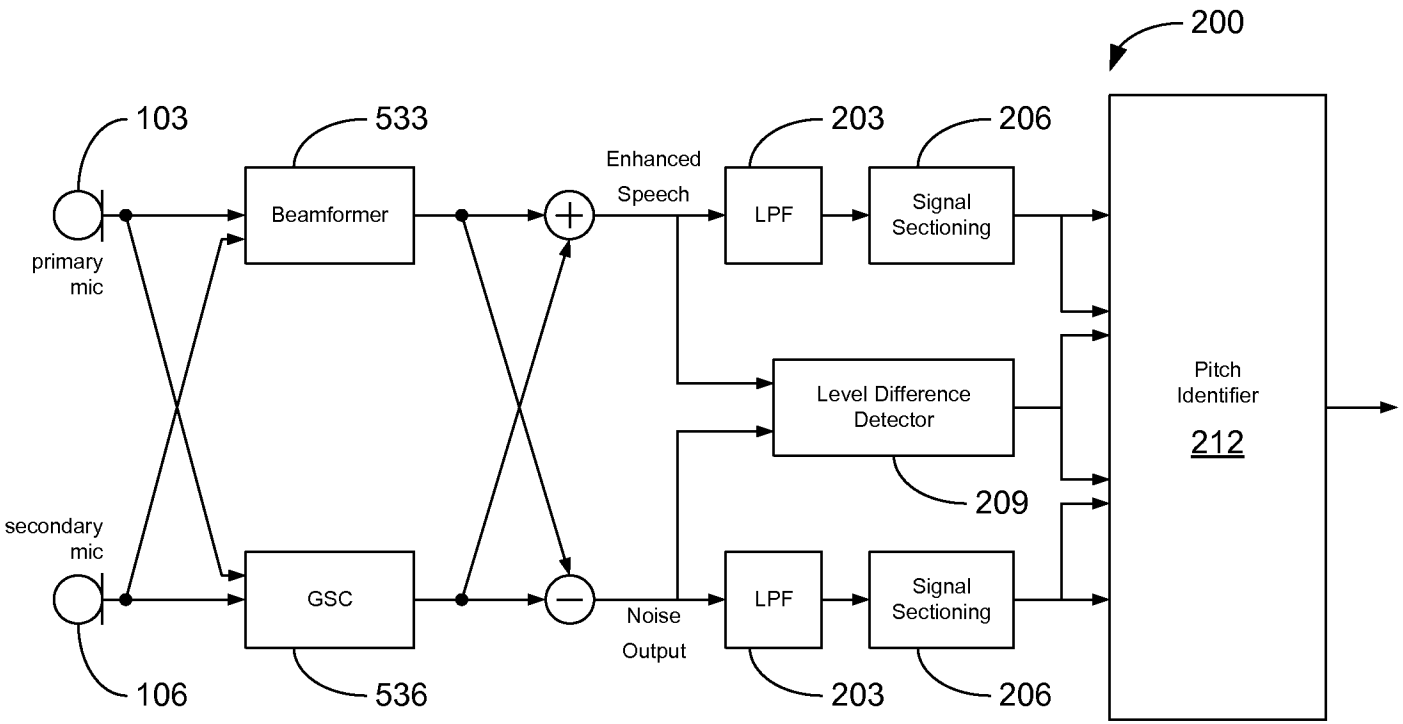

Pitch detection may also be accomplished using signals after beamforming and/or adaptive noise cancellation (ANC). Referring to FIG. 5, shown is a graphical representation of another example of the low complexity multi-mic based pitch detector 200. Instead of using a level difference determined from input signals taken directly from the primary and secondary microphones 103 and 106 as illustrated in FIG. 2, the level difference may be determined based upon the output signals after beamforming, ANC, and/or other processing. This allows the low complexity multi-mic based pitch detector 200 to be applied to microphone configurations that does not have a noise reference microphone at the back of the device or configurations with more than two microphones.

In the example of FIG. 5, the outputs of the beamformer 533 and the GSC 536 may be summed to provide an enhanced speech signal as the primary input signal to the level difference detector 209 and the difference may be used to provide a noise output signal as the secondary input signal to the level difference detector 209. This variation may be used for hardware that does not include a noise reference microphone as the secondary microphone 106 or when using pitch detection after beamforming or ANC. The level difference detector 209 determines the level difference between the enhanced speech and noise output signals. The enhanced speech and noise output signals each pass through a LPF 203 and are sectioned 206 for further processing in the pitch identifier 212 to determine the final pitch value based upon the determined level difference.

Figure 9:
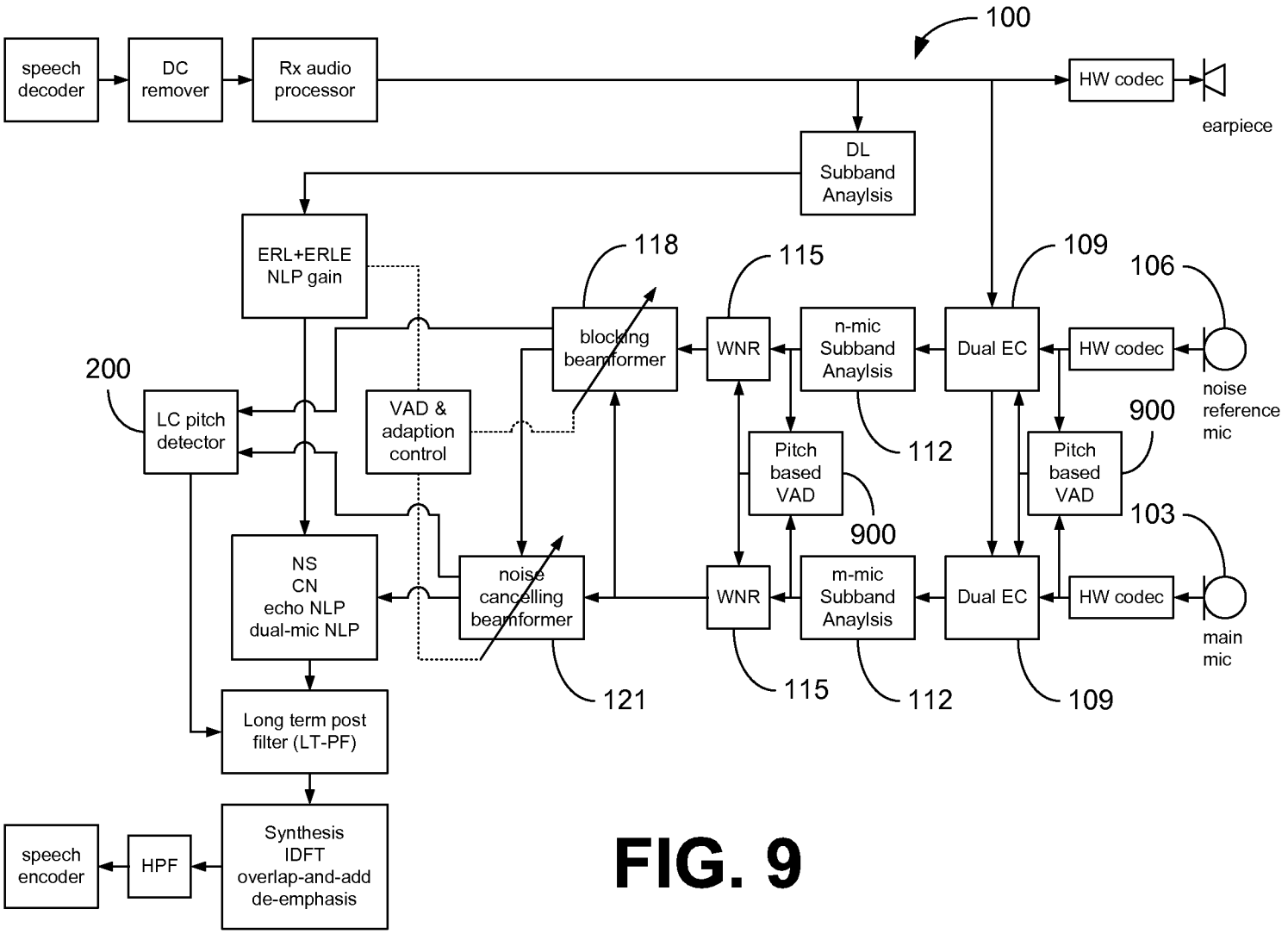
FIG. 9 is a graphical representation of a dual-mic DSP audio system of FIG. 1 including a low complexity multi-mic based pitch detector of FIGS. 2 and 5-7 and pitch based voice activity detection of FIG. 8 in accordance with various embodiments of the present disclosure.

In some instances, as illustrated in FIG. 9, the pitch may be based upon signals from the blocking beamformer 118 and the noise cancelling beamformer 121. The output from the noise cancelling beamformer 121 may be used as the primary input signal and the output from the blocking beamformer 118 may be used as the secondary input signal to the determine the level difference between the speech and noise outputs of the beamformer signals. The outputs of the blocking beamformer 118 (FIGS. 1 and 9) and the noise cancelling beamformer 121 (FIGS. 1 and 9) each pass through a LPF 203 (FIG. 5) and signal sectioning 206 (FIG. 5) before further processing by the pitch identifier 212 to determine the final pitch value based upon the determined level difference as previously described.

Figure 6:
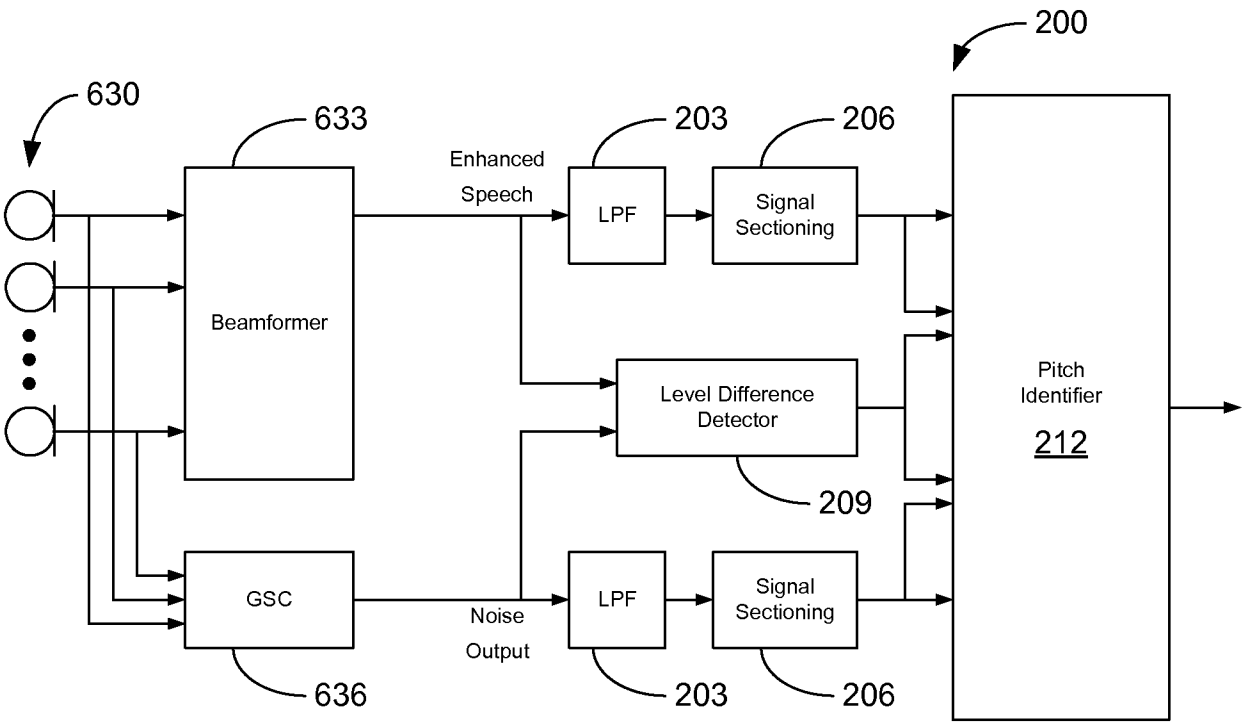

A multi-mic based pitch detector may also include inputs from multiple microphones using a multiple channel based beamformer. Referring to FIG. 6, shown is a graphical representation of an example of the low complexity multi-mic based pitch detector 200 with a multi-mic beamformer. In the example of FIG. 6, a plurality of microphones 630 are used to provide inputs to a beamformer 633. Beamformer 633 may adopt either fixed or adaptive multi-channel beamforming to provide an enhanced speech signal to the level difference detector 209. The inputs from the plurality of microphones 630 are also provided to a GSC 636 to generate a noise output signal that is provided to the level difference detector 209. As in the example of FIG. 5, the level difference detector 209 determines the level difference between the enhanced speech and noise output signals. The enhanced speech and noise output signals each pass through a LPF 203 and are sectioned 206 for pitch detection in the pitch identifier 212 based upon the determined level difference.

Figure 7:
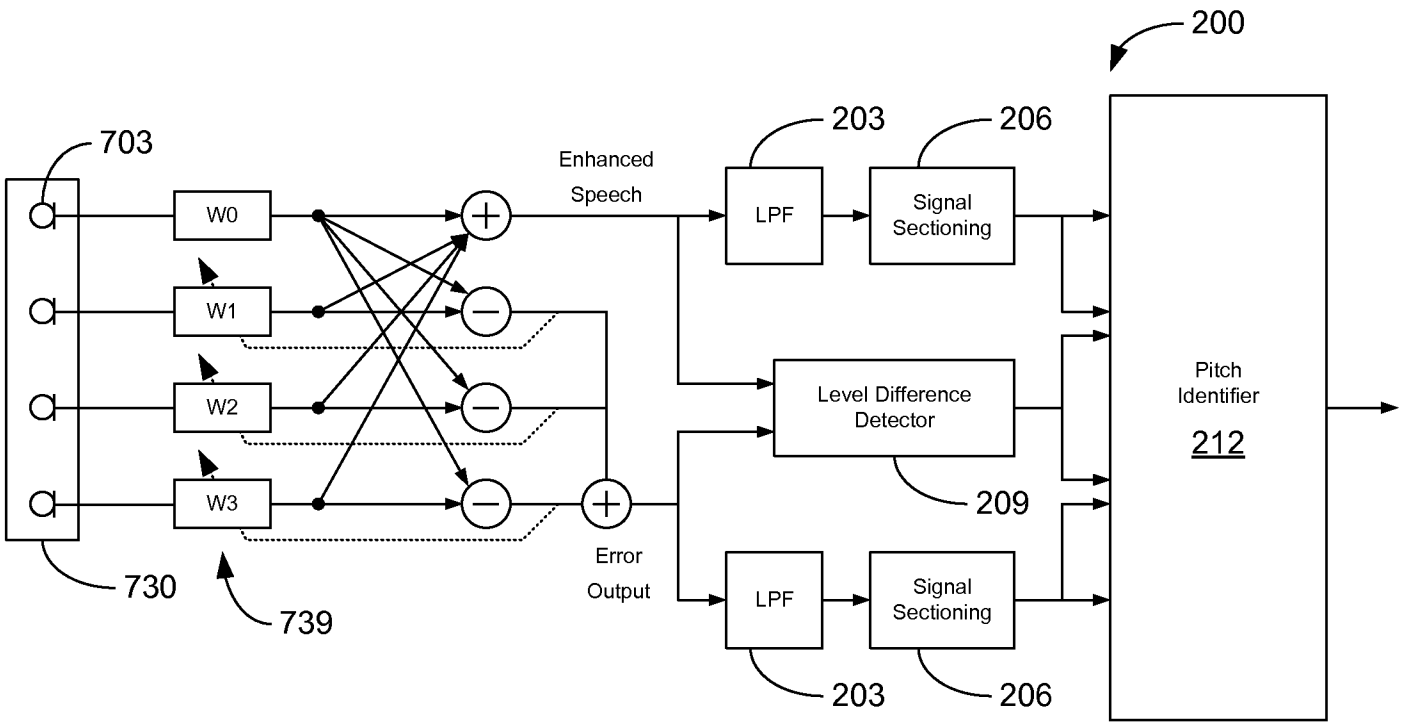

Pitch detection may also be used in hands-free applications including inputs from an array of a plurality of microphones (e.g., built-in microphones in automobiles). Referring to FIG. 7, shown is a graphical representation of an example of the low complexity multi-mic based pitch detector 200 with input signals from an array of four microphones 730. An output signal from a first microphone 703 is summed with weighted 739 output signals from other microphones in the array 730 to provide an enhanced speech signal as the primary input signal to level difference detector 209. The output signal from a first microphone 703 may also be weighted before summing. Error signals are determined by taking the difference between the output signal from the first microphone 703 and each of the output signals from the other microphones in the array 730. In the example of FIG. 7, the error signals are combined to provide an error output signal as the noise input signal of level difference detector 209. In other implementations, a portion of the error signals may be combined as the secondary input signal. In some implementations, only one of the error signals is used as the secondary input signal. In other implementations, the error signals may be weighted first, and then combined to provide an error signal. In some cases, the weighting may be adapted or adjusted based upon, e.g., the error signals.

The level difference detector 209 determines the level difference between the enhanced speech and error output signals. The enhanced speech and error output signals each pass through a LPF 203 and signal sectioning 206 for pitch detection in the pitch identifier 212 based upon the determined level difference as previously described. The final pitch value may be used in conjunction with the error signals from the other microphones in the array 730 to, e.g., provide additional adaptive noise cancellation of the enhanced speech signal.

Figure 8:
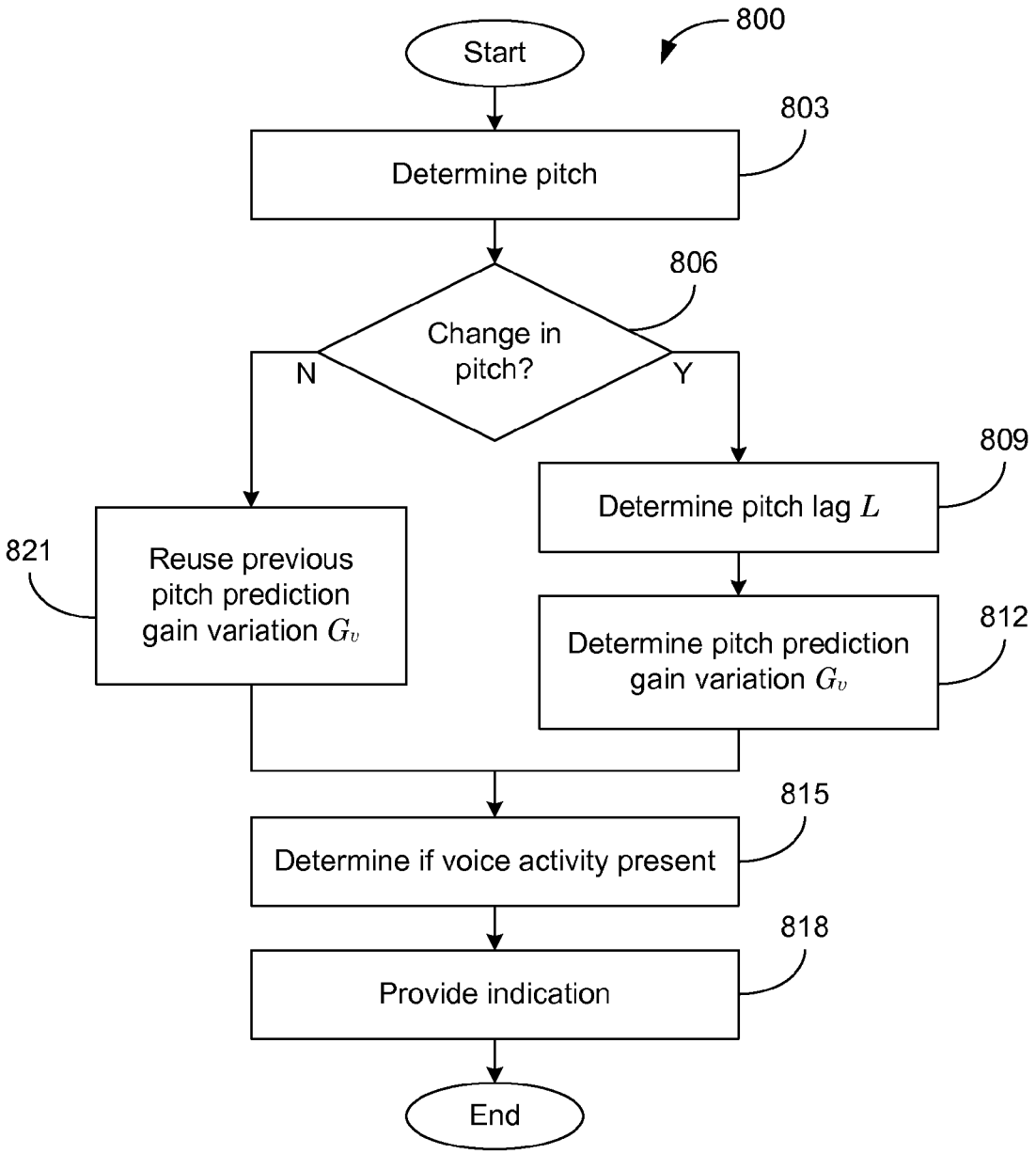
FIG. 8 is a flowchart illustrating an example of pitch based voice activity detection using a low complexity multi-mic based pitch detector of FIGS. 2 and 5-7 in accordance with various embodiments of the present disclosure.

The low complexity multi-mic based pitch detector 200 may also be used for detection of voice activity. A pitch based voice activity detector (VAD) may be implemented using the final pitch value of the low complexity multi-mic based pitch detector 200. FIG. 8 is a flow chart 800 illustrating the detection of voice activity. Initially, the pitch for the current pitch searching period is determined in block 803. In block 806, if the pitch has changed from the previous pitch searching period, then the pitch lag L is determined based upon the final pitch value in block 809. The pitch lag corresponds to the inverse of the fundamental frequency (i.e., pitch) of the current pitch searching period (or frame) of the speech signal. For example, if the final pitch value is 250 Hz, then the pitch lag is 4 ms. The pitch lag L corresponds to a number of samples based upon the A/D conversion rate.

In block 812, a pitch prediction gain variation ($G_v$) is determined based upon the autocorrelation of the analyzed signals for each pitch searching period (or frame) using:

$$G_v = \frac{R[0, 0] * R[L, L]}{R[0, L] * R[0, L]}$$

where the pitch lag L is associated with the pitch searching frame of the analyzed signal. Determination of the pitch prediction gain variation ($G_v$) instead of pitch prediction gain itself can reduce processing requirements and precision lost by simplifying the computation. In addition, determining $G_v$ based upon the pitch searching frame instead of the sectioned signal (i.e., the signals within the entire analysis window), which is used when calculating the pitch prediction gain, may also reduce memory requirements. However, the performance still remains the same.

In block 815, the pitch prediction gain variation ($G_v$) is compared to a threshold to detect the presence of voice activity. A small pitch prediction gain variation indicates the presence of speech and a large pitch prediction gain variation indicates no speech. For example, if $G_v$ is below a predefined threshold, than voice activity is detected. The threshold may be a fixed value or a value that is adaptive. An appropriate indication may then be provided in block 818.

If the pitch has not changed from the previous pitch searching period in block 806, then in block 821 the pitch prediction gain variation ($G_v$) for the previous pitch searching period is reused. The presence of voice activity may then be detected in block 815 and appropriate indication may be provided in block 818.

One or more low complexity multi-mic based pitch detector(s) 200 and/or pitch based VAD(s) may be included in audio systems such as a dual-mic DSP audio system 100 (FIG. 1). FIG. 9 shows an example of the dual-mic DSP audio system 100 including both a low complexity (LC) multi-mic based pitch detector 200 and pitch based VADs 900. The low complexity multi-mic based pitch detector 200 obtains input signals from the blocking beamformer 118 and the noise cancelling beamformer 121 and provides the final pitch value for long term post filtering (LT-PF). A first pitch based VAD 900 provides voice activity indications to dual EC 109 based upon input signals from the main (or primary) microphone 103 and the secondary (or noise reference) microphone 106. A second pitch based VAD 900 provides voice activity indications to WNR 115 based upon input signals from the sub-band analysis 112. The low complexity multi-mic based pitch detector 200 and the pitch based VADs 900 may be embodied in dedicated hardware, software executed by a processor and/or other general purpose hardware, and/or a combination thereof. For example, a low complexity multi-mic based pitch detector 200 may be embodied in software executed by a processor of the dual-mic DSP audio system 100 or a combination of dedicated hardware and software executed by the processor.

It is understood that the software or code that may be stored in memory and executable by one or more processor(s) as can be appreciated. Where any component discussed herein is implemented in the form of software, any one of a number of programming languages may be employed such as, for example, C, C++, C#, Objective C, Java, Java Script, Perl, PHP, Visual Basic, Python, Ruby, Delphi, Flash, or other programming languages. In this respect, the term "executable" means a program file that is in a form that can ultimately be run by the processor. Examples of executable programs may be, for example, a compiled program that can be translated into machine code in a format that can be loaded into a random access portion of the memory and run by the processor, source code that may be expressed in proper format such as object code that is capable of being loaded into a random access portion of the memory and executed by the processor, or source code that may be interpreted by another executable program to generate instructions in a random access portion of the memory to be executed by the processor, etc. An executable program may be stored in any portion or component of the memory including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

Although various functionality described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The graphical representations of FIGS. 2 and 5-7 and the flow chart of FIG. 8 show functionality and operation of an implementation of portions of pitch detection and voice activity detection. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor or other general purpose hardware. The machine code may be converted from the source code, etc. If embodied in hardware, each block may represent a circuit or a number of interconnected circuits to implement the specified logical function(s).

Although the flow chart of FIG. 8 shows a specific order of execution, it is understood that the order of execution may differ from that which is depicted. For example, the order of execution of two or more blocks may be scrambled relative to the order shown. Also, two or more blocks shown in succession in FIG. 8 may be executed concurrently or with partial concurrence. Further, in some embodiments, one or more of the blocks shown in FIG. 8 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any application or functionality described herein that comprises software or code can be embodied in any non-transitory computer-readable medium for use by or in connection with an instruction execution system such as, for example, a processor or other general purpose hardware. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system. The computer-readable medium can comprise any one of many physical media such as, for example, electronic, magnetic, optical, electromagnetic, infrared, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a range of "about 0.1% to about 5%" should be interpreted to include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, having thus described the invention, at least the following is claimed:

1. A method, comprising:

obtaining, by a computing device, a primary signal corresponding to a primary microphone and a secondary signal corresponding to a secondary microphone;

determining, by the computing device, a level difference between the primary and secondary signals; and determining, by the computing device, a pitch value based at least in part upon the determined level difference of the primary and secondary signals.

2. The method of claim 1, wherein determining the pitch value includes determining, by the computing device, a clipping level based upon the level difference.

3. The method of claim 2, wherein determining the pitch value further includes:

clipping, by the computing device, a portion of the primary signal using the determined clipping level; and determining, by the computing device, a pitch value associated with the portion of the primary signal based upon autocorrelation of the clipped portion of the primary signal.

4. The method of claim 3, wherein determining the pitch value further includes determining, by the computing device, a clipping level for the secondary signal based upon the level difference.

5. The method of claim 4, wherein determining the pitch value further includes:

clipping, by the computing device, a portion of the secondary signal using the determined clipping level for the secondary signal; and determining, by the computing device, a pitch value associated with the portion of the secondary signal based upon autocorrelation of the clipped portion of the secondary signal.

6. The method of claim 5, wherein determining the pitch value further includes determining, by the computing device, a final pitch value based upon the pitch value associated with the primary signal and the pitch value associated with the secondary signal.

7. The method of claim 3, wherein the primary and secondary signals are sectioned to provide the portion of the primary signal and a corresponding portion of the secondary signal.

8. The method of claim 2, wherein a ratio of the averaged Teager Energy Operator (TEO) energy ($R_{TEO}$) of the primary and secondary signals represents the level difference between the primary and secondary signals.

9. The method of claim 8, wherein the clipping level is based at least in part upon an adaptive factor that varies between a minimum value and a maximum value based upon the $R_{TEO}$.

10. The method of claim 8, wherein the adaptive factor varies exponentially within a defined range of the $R_{TEO}$.

11. A system, comprising:

a plurality of microphones configured to provide a primary signal and a secondary signal;

a level difference detector configured to determine a level difference between the primary and secondary signals; and a pitch identifier configured to clip the primary and secondary signals based at least in part upon the level difference.

12. The system of claim 11, wherein the pitch identifier is further configured to determine a pitch value based at least in part upon autocorrelation of the clipped primary signal and autocorrelation of the clipped secondary signal.

13. The system of claim 11, wherein the pitch identifier is further configured to determine a clipping level based at least in part upon the level difference.

14. The system of claim 13, wherein the level difference is a ratio of the averaged Teager Energy Operator (TEO) energy ($R_{TEO}$) of the primary and secondary signals.

15. The system of claim 13, wherein the primary and secondary signals are sectioned into a plurality of corresponding signal sections before clipping, each signal section including a pitch searching frame and a portion that overlaps with an adjacent signal section.

16. The system of claim 11, wherein a primary microphone provides the primary signal and a noise reference microphone provides the secondary signal.

17. The system of claim 11, wherein a speech output of a beamformer provides the primary signal based upon signals from the plurality of microphones and a noise output of a beamformer provides the secondary signal based upon the signals from the plurality of microphones.

18. A method, comprising:

obtaining, by a computing device, a section of a primary signal and a corresponding section of a secondary signal, the primary and secondary signals associated with a plurality of microphones;

determining, by the computing device, a pitch value based at least in part upon a level difference between the primary signal and secondary signal;

determining, by the computing device, a pitch lag based upon the pitch value;

determining, by the computing device, a pitch prediction gain variation for the primary signal section based at least in part upon the pitch lag; and determining, by the computing device, the presence of voice activity based upon the pitch prediction gain variation.

19. The method of claim 18, wherein the pitch prediction gain variation is determined with a pitch searching frame of the primary signal section.

20. The method of claim 18, wherein the pitch prediction gain variation is compared to a predefined threshold to determine the presence of voice activity.

* * * * *